US010952007B2

(12) United States Patent
van Laack et al.

(10) Patent No.: US 10,952,007 B2
(45) Date of Patent: Mar. 16, 2021

(54) PRIVATE AUDIO SYSTEM FOR A 3D-LIKE SOUND EXPERIENCE FOR VEHICLE PASSENGERS AND A METHOD FOR CREATING THE SAME

(71) Applicant: Faurecia Innenraum Systeme GmbH, Hagenbach (DE)

(72) Inventors: Alexander van Laack, Aachen (DE); Laurent Tapin, Lure (FR); Omar Ben Abdelaziz, Tille (FR)

(73) Assignee: Faurecia Innenraum Systeme GmbH, Hagenbach (DE)

( * ) Notice: Subject to any disclaimer, the term of this patent is extended or adjusted under 35 U.S.C. 154(b) by 0 days.

(21) Appl. No.: 16/443,643

(22) Filed: Jun. 17, 2019

(65) Prior Publication Data

US 2019/0394604 A1 Dec. 26, 2019

(30) Foreign Application Priority Data

Jun. 20, 2018 (DE) ..... 10 2018 209 962.6

(51) Int. Cl.

| | |
|---|---|
| ***H04S 7/00*** | (2006.01) |
| ***H04R 5/02*** | (2006.01) |
| ***H04R 5/04*** | (2006.01) |
| ***H04S 3/00*** | (2006.01) |
| ***G10K 11/178*** | (2006.01) |

(52) U.S. Cl.

CPC ..... *H04S 7/303* (2013.01); *G10K 11/17823* (2018.01); *H04R 5/02* (2013.01); *H04R 5/04* (2013.01); *H04S 3/008* (2013.01); *G10K 2210/3044* (2013.01); *H04R 2499/13* (2013.01); *H04S 2400/01* (2013.01); *H04S 2400/13* (2013.01); *H04S 2420/01* (2013.01)

(58) Field of Classification Search

CPC .. H04S 7/303; H04S 2400/13; H04S 2420/01; G10K 11/17823; G10K 2210/3044; H04R 5/04; H04R 5/02; H04R 2499/13

See application file for complete search history.

(56) References Cited

U.S. PATENT DOCUMENTS

| | | | | |
|---|---|---|---|---|
| 2016/0257227 | A1* | 9/2016 | Takada | B60R 11/0217 |
| 2016/0329040 | A1* | 11/2016 | Whinnery | G10K 11/178 |
| 2016/0336022 | A1* | 11/2016 | Florencio | H04R 3/12 |
| 2018/0091085 | A1* | 3/2018 | Tamagaki | B60T 17/18 |
| 2018/0199136 | A1* | 7/2018 | Sculley | H04R 3/12 |
| 2019/0304431 | A1* | 10/2019 | Cardinaux | G10K 11/17813 |
| 2020/0105288 | A1* | 4/2020 | Cheung | H04R 1/403 |

* cited by examiner

*Primary Examiner* — Regina N Holder

(74) *Attorney, Agent, or Firm* — Schwegman Lundberg & Woessner, P.A.

(57) ABSTRACT

A private audio system for a 3d like sound experience for a vehicle passenger comprising: at least one acoustic sound emitter configured to transmit sound from an audio source in an audio frequency; at least one ultrasonic speaker configured to transmit an audio beam from an audio source, wherein the audio beam is orientable relative to the passenger; a passenger monitoring unit configured to track a location of a passenger's head; a signal processor configured to detect the location of the passenger's ears and to control the orientation of the ultrasound audio beam based on information provided by the passenger monitoring unit.

12 Claims, 2 Drawing Sheets

PRIVATE AUDIO SYSTEM FOR A 3D-LIKE SOUND EXPERIENCE FOR VEHICLE PASSENGERS AND A METHOD FOR CREATING THE SAME

CLAIM FOR PRIORITY

This application claims the benefit of priority of German Application Serial No. 10 2018 209 962.6, filed Jun. 20, 2018, which is hereby incorporated by reference in its entirety.

TECHNICAL FIELD

This patent application relates to the field of vehicular audio systems. Specifically, but not by way of limitation, the subject matter of this patent application relates to a private audio system that uses ultrasonic emitters together with acoustic speakers to provide a private three-dimensional (3D) audio experience for a vehicle passenger, a method for creating the same, and to a vehicle.

BACKGROUND

Increasingly, cars are shared by people who are strangers to each other. This is especially true in ride-sharing scenarios. Most current vehicular audio systems produce an output that is audible to everyone in the car. This is a problem because it means that the privacy of the passengers, who probably do not share similar interests and needs, and desire differing infotainment experiences, is not ensured. For instance, only the driver of the vehicle might be interested in navigational props and other vehicle alerts.

Furthermore, even if all the passengers want to listen to the same audio feed, two problems are nevertheless present. The first relates to the presence of other technologies such as Bluetooth devices, cell-phones etc., that can interfere with audio signals and lead to a degraded audio experience for vehicular passengers. Secondly, even for the same audio feed, passengers may want to adjust the volume (and other sound effects) according to their preference.

SUMMARY

Thus, the present inventors have recognized, among other things, that in most current vehicular audio systems, there is neither privacy for passengers nor an opportunity for them to have a personalized audio experience. One way to solve these problems is to create individual 'sound zones', and to create such individual sound zones by placing acoustic speakers near passengers (e.g. in the headrests and/or the headliner) so that the audio experience is enhanced, and also private.

However, in such systems, the sound seems to emanate from behind the passenger's head. This is in contrast to how top audio systems stage music in front of the listener. Thus, this creates a problem in that the passenger does not get an immersive, 3D-like audio experience.

The subject matter of this patent application provides a solution to this problem. An objective of the subject matter of this application can be to provide a private audio system for vehicle passengers, and a method for creating the same, that provides users with a personalized, 3D-like audio experience, by combining the sound from acoustic sound emitters placed in close proximity to a passenger, with the sound from ultrasonic speakers that directs audio beams directly to the passenger's ears. Furthermore, a passenger monitoring unit monitors the head movement of the passenger. This information is then used by a signal processor to identify the location of the passenger's ears and to orient the direction of the audio beam to the identified ears.

An example of the embodiments of the subject matter of this patent application is a private audio system for a vehicle passenger comprising: at least one acoustic sound emitter for transmitting sound from an audio source in an audio frequency range; at least one ultrasonic speaker configured to transmit an audio beam from an audio source, wherein the audio beam is orientable relative to the passenger. The benefit of using an ultrasonic speaker is that it can direct sound in a narrow beam and aim it only at a single passenger so that others are not disturbed and are also not privy to what the passenger hears, thereby allowing the passenger to have a private audio experience. The private audio system further comprises a passenger monitoring unit, configured to track the location of a passenger's head. Tracking the location of the passenger's head means that monitoring unit can determine a location and a change in the location of the head. This is beneficial because each passenger, based on her height and built, may have his head and consequently also his ears in different locations. Further, the passenger may occasionally move to another place in the vehicle so that also his head may change location. Since the audio beam from the ultrasonic emitter should be narrow so as to only be audible to the passenger, it is necessary to know the exact location of the passenger's ears, otherwise, the beam might not be well directed and thus be inaudible to the passenger. Towards that end, the information from the passenger monitoring unit is used by a signal processor to identify the location of a passenger's ears and to control the orientation of the ultrasonic beam and direct it towards the identified ears. This can be done either through mechanical means, e.g., through rotating the ultrasonic speaker if it is situated on a swivel based mounting bracket, or, preferably, changing the direction of the audio beam through electronic means. In this way, the passenger can have a 3D-like, private audio experience.

A further example takes the form of the private audio system of the first example, where there are multiple acoustic sound emitters for transmitting sound from multiple audio sources; multiple ultrasonic speakers to transmit audio beams from multiple audio sources; multiple passenger unit for tracking the heads of multiple passengers, and multiple signal processors to direct beams from the ultrasonic speakers to the ears of the respective passenger. This is advantageous for providing a private audio experience for multiple passengers in a vehicle, where the passengers have the option to listen to different audio sources. For instance, one passenger may privately listen to a sports show, while another may talk to someone on the phone, while the driver may hear the navigation props and vehicle alerts. Although it is preferred to have multiple signal processors and multiple monitoring units, in other embodiments, one head monitoring unit, and/or one signal processor, may satisfy to direct each beam from an ultrasonic speaker to the respective passenger. The single head monitoring unit may be arranged at the interior ceiling in order to capture multiple passengers.

A further example takes the form of the private audio system of any of the preceding examples, where the passenger monitoring unit comprises a camera to track the location of the passenger's head. The camera can be placed in front of the passenger to monitor his movements, in particular to monitor the movements of the passenger's head. The images from the camera are used by the signal processor to identify the location of the ears of the passenger. The location of the ears may for example be detected on the basis of the location and the orientation of the head. The location of the ears may also be determined by image analysis of pictures obtained by the camera. Detecting the location of the ears may in general also include detecting the orientation, more in particular detecting the front side of the head.

A further example takes the form of any of the preceding examples except for the last one, where the passenger monitoring unit comprises infrared sensors to track the location of a passenger's head and ears. The sensors can be placed in front of the passenger to monitor his movements, in particular to monitor the movements of the passenger's head. The information from the sensors is used by the signal processor to identify the head and ears of the passenger.

The acoustic sound emitters may be placed such that audio beams emitted from the acoustic sound emitters reach the passenger's head from the side and/or from behind. A further example takes the form of any of the preceding examples, where the acoustic sound emitters are placed in the headrests of the passenger seat. The passenger seat offers the unique advantage to be as close to the human body as no other interior part. Thus, the proximity of the headrest to the head can be used to bring the acoustic emitters as close to the ears as needed to create an ideal sound transmission. Another advantage of having the acoustic sound emitters close to the ears of the passenger is that others are not disturbed by the emitted sound because the sound volume can be kept low. A distance between the acoustic sound emitters and the ears of the passenger may, in some embodiments, amount to at most 30 cm.

The ultrasonic speakers may be placed such that the audio beams emitted from the ultrasonic speakers reach the passenger's head from the front. A further example takes the form of any of the preceding examples, where the ultrasonic speakers are part of an interior part, in particular in front of a passenger, preferably the ultrasonic speakers are placed in or below the instrument panel. However, the ultrasonic speakers may also be placed at other locations in the interior of the vehicle from which the audio beam can be directed towards the ears of the passenger, for example in or at the A-pillar, the B-pillar, the ceiling, the center console, or a door panel, of the vehicle. This is advantageous because for providing a high quality 3D-like audio experience to the passenger, the sound should come from the front rather than from behind the passenger. Also, the narrow ultrasonic audio beams ensure that the sound is only audible to a single passenger despite the fact that there are more passengers for who the audio source is in front, which would not be the case with ordinary acoustic sound emitters. The ultrasonic speakers are typically placed and configured such that the audio beams emitted from the ultrasonic speakers reach the passenger's head directly, in particular not after reflecting from a reflective surface.

A further example takes the form of any of the preceding examples, where the private audio system further comprises at least one control unit configured to control the time delays and volume differences between the acoustic sound emitters and ultrasonic speakers. This is advantageous because the different propagation characteristics of the ultrasonic beams and the sound waves from the acoustic emitter and theft different proximity from the passenger may cause an unnatural time delay between the audio arriving via the acoustic emitters and the ultrasonic speaker. Accordingly, the control unit ensures that the sounds arrive at the proper time, to provide an optimal audio experience to the passenger.

A further example takes the form of any of the preceding examples, where the signal processor is configured to orient the ultrasonic beam emitted by the ultrasonic speakers to align with the passenger's ears. The signal processor feeds the information from the passenger unit (either camera images or sensory data) into a face detection algorithm to identify the head and ears of the passenger, and orients the beam of the ultrasonic speakers towards the identified ears. In another implementation, the signal processor may be a part of the passenger monitoring unit.

A further example takes the form of any of the preceding examples where the private audio system further comprises at least one noise cancellation unit configured to cancel crosstalk, and also the noise from the known audio content from the other passengers. This allows an even stronger encapsulation and a more private audio experience for a passenger. Since the audio content of all passengers is known, this can aid in better noise cancellation in that not only crosstalk and other noise, but also the audio content of other passengers (if it is leaking) can be cancelled.

A further example relates to a method, as it applies preferably to a private audio system of any of the previous examples, according to which the passenger monitoring unit tracks the head of a passenger. This can be achieved by placing a camera or sensors in front of the passenger. Based on this information, the signal processor detects the head and ears of the passenger. This can be achieved by using a face detection algorithm. On determining the location of a passenger's ears the signal processor orients the ultrasonic speaker such that it propagates an audio beam directly at the passenger's ears.

BRIEF DESCRIPTION OF THE DRAWINGS

The disclosure may be more completely understood in consideration of the following description of various illustrative embodiments in connection with the accompanying drawings in which.

DETAILED DESCRIPTION

Figure 1:
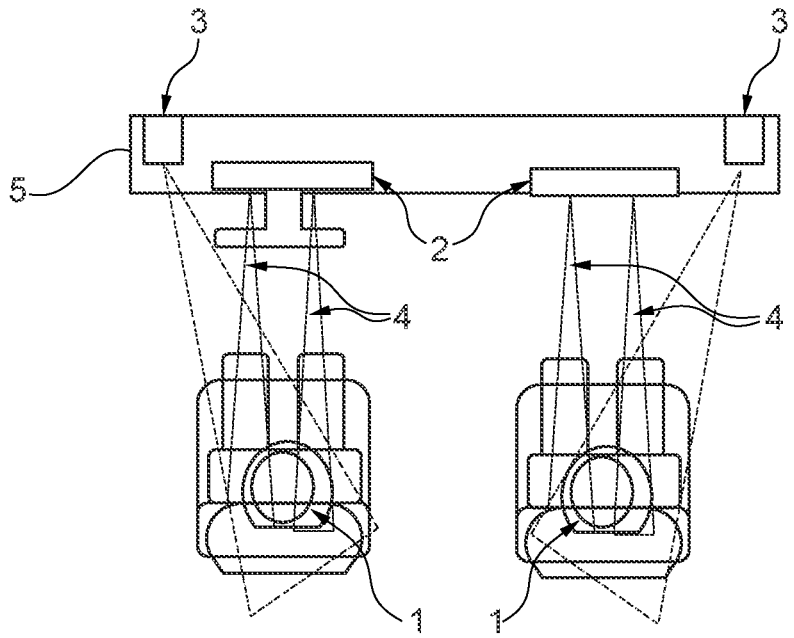
FIG. 1 illustrates a private audio system, duplicated for two front seat passengers.

While the disclosure is amenable to various modifications and alternative forms, specifics thereof have been shown by way of example in the drawings and will be described in detail. It should be understood, however, that the intention is not to limit aspects of the disclosure to the particular illustrative embodiments described. On the contrary, the intention is to cover all modifications, equivalents, and alternatives falling within the scope of the disclosure.

As shown in FIG. 1, acoustic sound emitters 1 are placed in the headrest of the seat, while ultrasonic speakers 2 are placed in front of each of the front row passengers. The acoustic sound emitters may emit sound in a frequency range that lies with the range between 20 Hz and 20,000 Hz, whereas the ultrasonic speakers may emit sound in a frequency range that lies above 20,000 Hz. It is desirable to place the acoustic speakers in as close proximity to a passenger as possible, and the headrest serves as an ideal location. Therefore, one speaker is positioned at the right hand side of the head of a person sitting in the seat and another speaker is positioned at the left hand side. The headrest may comprise wings at each side of a central part. Those wings comprising the speakers may be at a fixed location or they may be movable for optimal orientation relative to the ears of the passenger. A close location of the acoustic speakers to the passenger ensures that the passenger gets an ideal audio experience, while also keeping the audio content private. However, while having acoustic emitters in the headrest provides privacy, it does not provide an immersive audio experience to the user. It is observed that passengers feel that the sound is coming from behind them, which is a drastically different experience to how they usually experience audio using top audio systems that stage audio in front of them. Therefore, ultrasonic speakers should be placed in the front to provide the passenger with a 3D-like audio experience. Since passengers come in all shapes and sizes, and also move their head from time to time, the passenger monitoring unit 3, comprising either a camera or sensors is used for monitoring the passenger. This helps in detecting the ears of the passenger, so that the ultrasonic beams 4 are directed at the passenger's ears. Both ultrasonic speakers and the passenger unit are placed on an interior part 5 of the car.

Figure 2A:
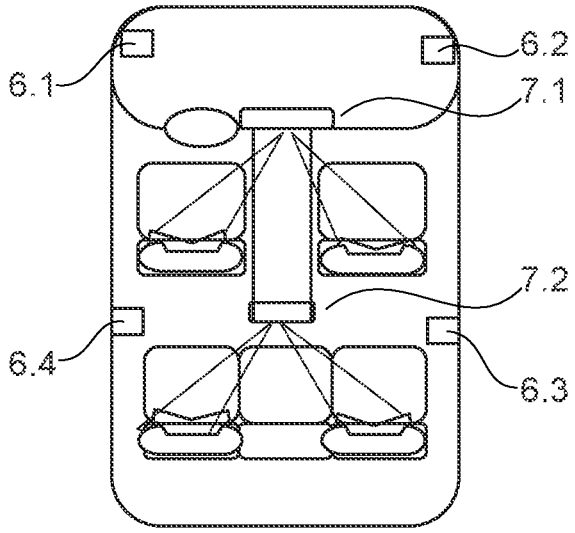
FIGS. 2*a* and 2*b* both illustrate the private audio system replicated for the front seat passengers as well as the back seat passengers, with different configurations for the ultrasonic speakers and the passenger monitoring units.
Figure 2B:
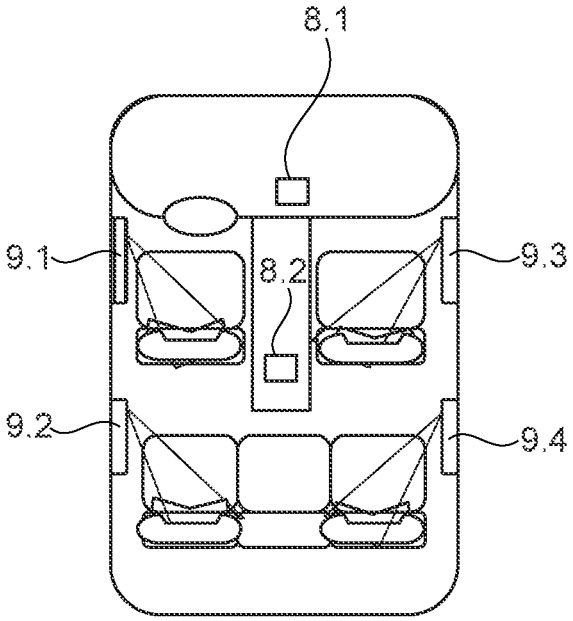

FIGS. 2*a* and 2*b* show the private audio system as in FIG. 1, replicated for front and rear seat passengers in a vehicle, with different configuration for the passenger monitoring unit and ultrasonic speakers. In FIG. 2*a*, there are four passenger monitoring units 6.1, 6.2, 6.3 and 6.4 for each of the four passengers. These can be either cameras or infrared sensors. There are two ultrasonic speakers 7.1 and 7.2 which direct audio beams to the two front and two rear passengers respectively, and are part of the center console (or center stack) of the vehicle.

In FIG. 2*b*, there are four ultrasonic speakers 9.1, 9.2, 9.3 and 9.4 that are part of the door panels. There are two passenger monitoring units 8.1, 8.2 for the two front and two rear passengers respectively.

Figure 3:
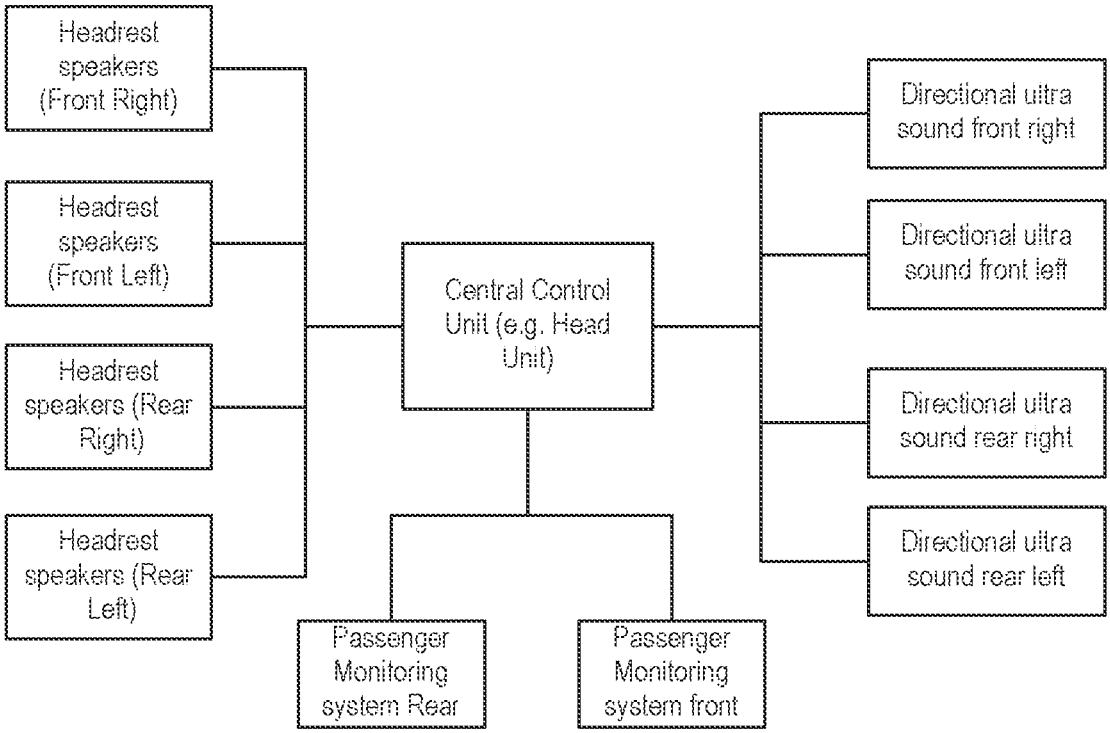
FIG. 3 illustrates the main components for a private audio system for both front seat and rear seat passengers.

FIG. 3 shows a component diagram of an implementation of the private audio system as illustrated in FIG. 2*b*. There are four headrest acoustic emitters/speakers and four ultrasonic speakers that direct ultrasound audio beams to the passengers ears. Of course, the amount of ultrasonic speakers can be adapted to the number of passenger seats in the vehicle. The central control unit ensures that the sound from the two different types of emitters/speakers (acoustic vs ultrasonic) reaches the passenger's ears at the proper time by controlling the time delays between the two. The passenger monitoring unit is an essential part of the system which allows for the ultrasonic speakers to direct the audio beam to the passenger's ears.

Figure 4:
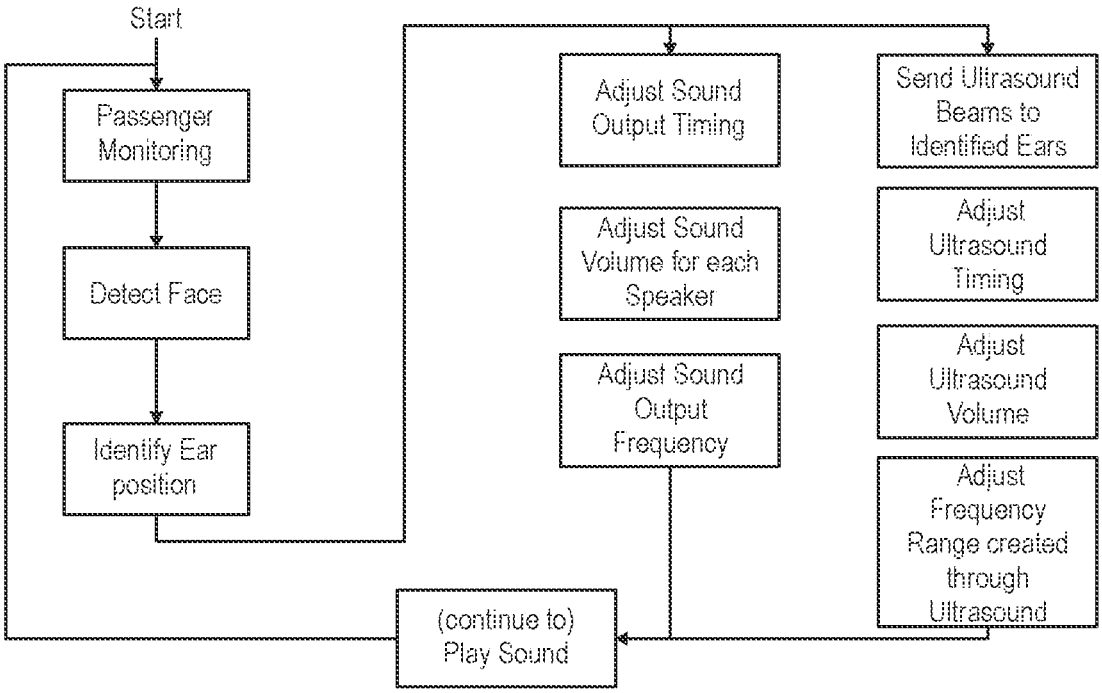
FIG. 4 illustrates a feedback loop according to which the components of the private audio system work together to provide a personalized, private, 3D-like audio experience for the passengers.

FIG. 4 illustrates a feedback loop of how the various components of the private audio system work together. Passenger Monitoring refers to tracking the passenger using either cameras or sensors. This is required because passengers come in all shapes and sizes. Also they may move their heads from time to time, thus changing the location of their ears. Based on this information, Detect Face implies the detection of the passenger's face and Identifying her Ear location, by using a face detection algorithm. Once the ear location is identified, the ultrasonic speakers can send ultrasound beams to identified ears. Also, the Adjust Sound Output Timing and Adjust Ultrasound Timing refer to controlling the time delay between the output of the acoustic emitters and ultrasonic speakers respectively. This is essential because of the potential time delay between the two due to their different propagation characteristics and proximity to the passenger's ears. The volume is also adjusted for similar reasons. Lastly, adjusting frequency range of the sound created by the ultrasonic speakers is required because humans cannot hear ultrasound. Normally, the ultrasonic speaker produces a modulated wave made of two separate ultrasound waves. The two waves are at different frequencies, both of which are ultrasonic and inaudible to the human ear. However, when they meet at the ear, they mix together and interfere with each other to produce a third wave with a much lower frequency, which is in the audible range. Based on the desired characteristics (e.g., passenger preference, or based on the content of the audio source), the frequencies of the two ultrasonic waves need to be adjusted so that the third audible wave is of a certain desired frequency. The ultrasonic beams emitted from the ultrasonic speakers and the audio beams emitted from the acoustic sound emitters may be synchronized such that the passenger hears a unified sound experience.

LIST OF REFERENCE NUMERALS

1. Acoustic emitters/speakers on the headrest
2. Ultrasonic speakers
3. Passenger monitoring unit
4. Ultrasonic audio beam
5. Interior part of the vehicle
6.1-6.4 Four Passenger monitoring units for front and rear passengers
7.1-7.2 Ultrasonic speakers as part of the center console.
8.1-8.2 Two passenger monitoring units for front and rear passengers
9.1-9.2 Ultrasonic speakers as part of the door panels.

The invention claimed is:

1. A private audio system for a vehicle passenger comprising: at least one acoustic sound emitter configured to transmit sound from an audio source in an audio frequency range; at least one ultrasonic speaker configured to transmit an audio beam from an audio source, wherein the audio beam is orientable relative to the passenger; a passenger monitoring unit, configured to track a location of a passenger's head; a signal processor configured to detect the location of the passenger's ears and to control the orientation of the ultrasound audio beam based on information provided by the passenger monitoring unit; further comprising a plurality of the acoustic sound emitters configured to transmit sound from a plurality of audio sources; a plurality of the ultrasonic speakers configured to transmit audio beams from a plurality of audio sources; a plurality of the passenger monitoring units; and wherein particular ones of the plurality of acoustic sound emitters and ultrasonic speakers, correspond to particular passengers among multiple passengers in the vehicle; further comprising at least one control unit, configured to control the time delays and volume differences between the acoustic sound emitters and ultrasonic speakers.

2. The private audio system of claim 1, wherein the passenger monitoring unit comprises a camera to track the location of the passenger's head and/or ears.

3. The private audio system of claim 1, wherein the passenger monitoring unit comprises infrared sensors to track the location of the passenger's head.

4. The private audio system of claim 1, wherein the acoustic sound emitters are placed such that audio beams emitted from the acoustic sound emitters reach the passenger's head from the side and/or from behind.

5. The private audio system of claim 1, wherein the ultrasonic speakers are placed such that the audio beams emitted from the ultrasonic speakers reach the passenger's head from the front.

6. The private audio system of claim 1, wherein the acoustic sound emitters are placed in the headrests of the passenger seats.

7. The private audio system of claim 1, wherein the ultrasonic speakers are part of an interior part in front of a passenger.

8. The private audio system of claim 1, wherein the signal processor is configured to detect a passenger's head and ears, using a face detection algorithm, and orient the ultrasonic audio beam emitted by the ultrasonic speakers to align with the passenger's ears.

9. The private audio system of claim 1, comprising at least one noise cancellation unit configured to cancel crosstalk, and the remaining noise from the known audio content of the other passengers.

10. The private audio system of claim 1, in which the interior part in front of the passenger includes at least one of the center console, the instrument panel, an A-pillar, a B-pillar, or a door panel, of the vehicle.

11. The private audio system of claim 1, included in a vehicle.

12. A method of providing a private audio system for a vehicle passenger the private audio system comprising one or more acoustic sound emitters configured to transmit sound from an audio source in an audio frequency range, one or more ultrasonic speakers configured to transmit an audio beam from an audio source, wherein the audio beam is orientable relative to the passenger, one or more passenger monitoring units, configured to track a location of a passenger's head, a signal processor configured to detect the location of the passenger's ears and to control the orientation of the ultra-sound audio beam based on information provided by the passenger monitoring unit; further comprising a plurality of the acoustic sound emitters configured to transmit sound from a plurality of audio sources; a plurality of the ultrasonic speakers configured to transmit audio beams from a plurality of audio sources; a plurality of the passenger monitoring units; and wherein particular ones of the plurality of acoustic sound emitters and ultrasonic speakers, correspond to particular Passengers among multiple Passengers in the vehicle; further comprising at least one control unit, configured to control the time delays and volume differences between the acoustic sound emitters and ultrasonic speakers, the method comprising the steps of: tracking by at least one of the passenger monitoring units the current position of the head of the passenger; based on the tracking information, locating the ears and adjusting the ultrasound speakers by the signal processor to align with the ears of the passenger; propagating an ultrasound beam by the ultrasound speaker directed at the ears of the passenger.

* * * * *